United States Patent [19]

Najarian

[11] 4,046,130

[45] Sept. 6, 1977

[54] TARGET PRACTICE ATTACHMENT FOR A FIREARM

[76] Inventor: George Najarian, 1956 Brown St., Brooklyn, N.Y. 11229

[21] Appl. No.: 615,142

[22] Filed: Oct. 16, 1975

[51] Int. Cl.[2] ..... F41B 7/00

[52] U.S. Cl. ..... 124/28; 124/41 C

[58] Field of Search ..... 124/1, 27, 31, 28, 41 R; 273/101.2

[56] References Cited

U.S. PATENT DOCUMENTS

| | | | |
|---|---|---|---|
| 723,227 | 3/1903 | Anthony | 124/27 X |
| 1,483,378 | 2/1924 | Reardon | 124/2 8 |
| 2,939,449 | 6/1960 | Kortick | 124/27 X |
| 3,735,748 | 5/1973 | Gaylord | 124/41 R |
| 3,897,061 | 7/1975 | Grattan | 124/41 R X |

*Primary Examiner*—Richard C. Pinkham
*Assistant Examiner*—William R. Browne
*Attorney, Agent, or Firm*—Bauer, Amer & King

[57] ABSTRACT

An attachment is provided for a firearm, such as a handgun, with the attachment being adapted for use during target practice. The attachment includes a cylinder which is releasably secured to the barrel of the firearm. A needle-like rod is contained within the cylinder and is ejected therefrom after the trigger is pulled. A pair of arms extend outwardly from the cylinder proximate the rearward end thereof with the inner end of the arms being coupled to the rod and with the outer end of the arms being adapted to be struck by a portion of the hammer of the firearm. The target is reduced in scale and is placed only several inches away from the muzzle of the firearm. In one embodiment of the invention, a spring is utilized for returning the rod to its initial, retracted position after each firing. In another embodiment of the invention an external spring clip or latch extends into the cylinder and is adapted to releasably retain the rod prior to the firing thereof.

10 Claims, 4 Drawing Figures

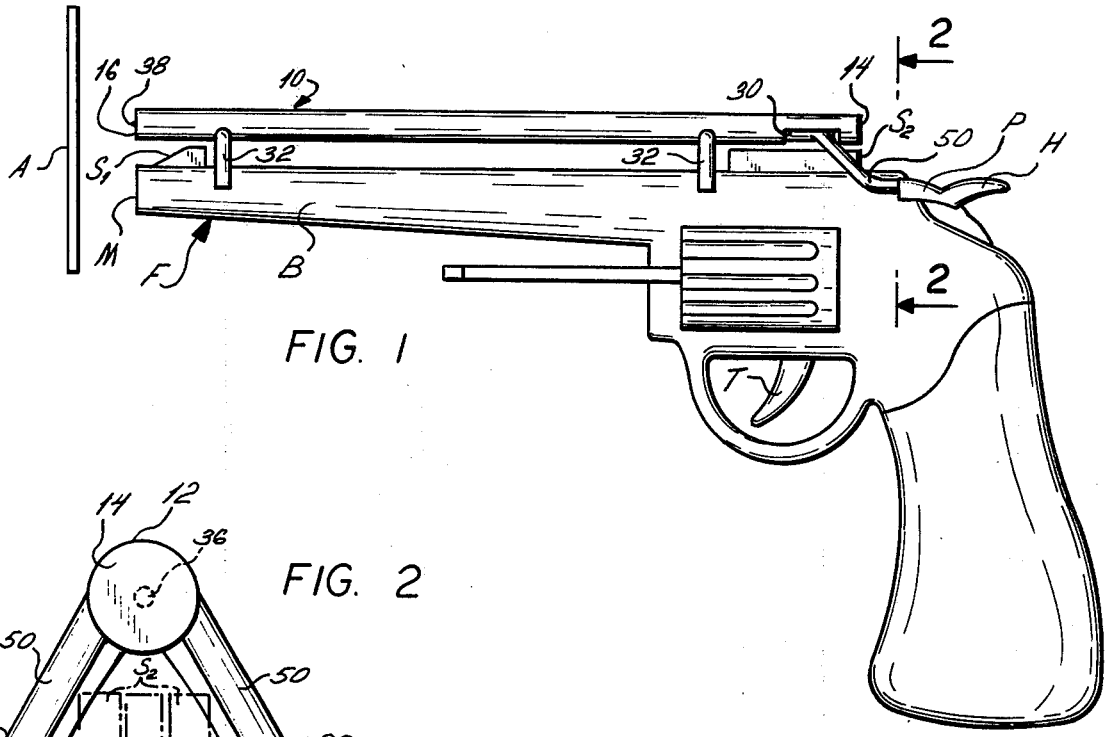
FIG. 1
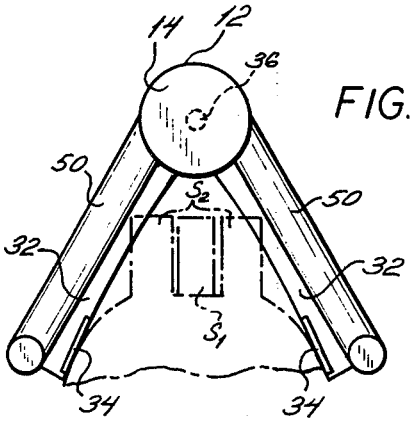
FIG. 2
FIG. 3
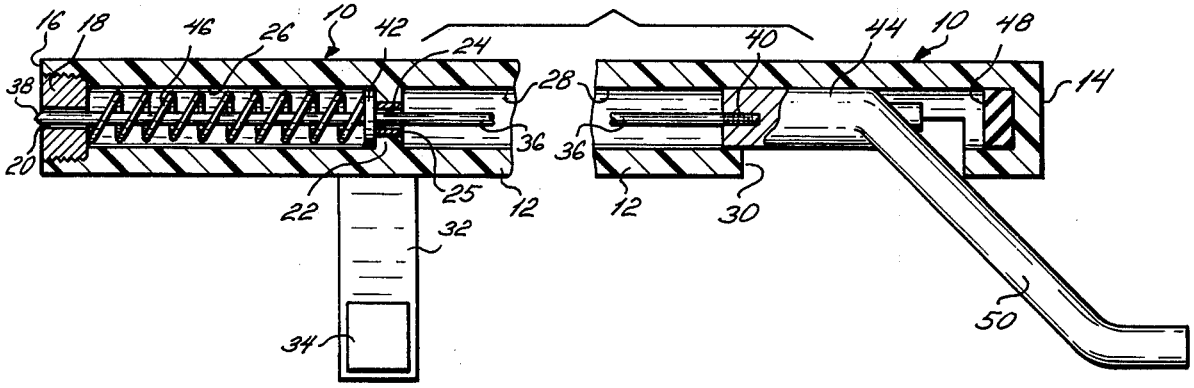
FIG. 4
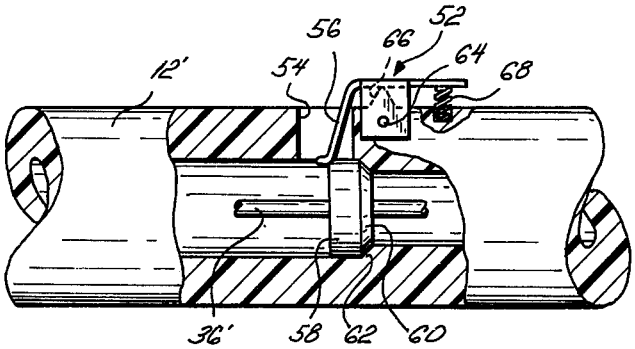

TARGET PRACTICE ATTACHMENT FOR A FIREARM

BACKGROUND OF THE INVENTION

1. Field of the Invention

This invention relates generally to firearms and more particularly to an attachment therefore that may be used during target practice.

2. DESCRIPTION OF THE PRIOR ART

There has been a long standing need for means which will permit target practice with firearms without the use of the conventional indoor or outdoor ranges which must necessarily be of considerable length. There is also a long standing need for means which will permit target practice without the use of conventional ammunition. It will be evident that where either indoor or outdoor target practice ranges are used and where live ammunition is used there is considerable cost involved and, under certain conditions, the noise that results from the target practice can be objectionable. However, it will also be apparent that, if a system can be devised for overcoming the foregoing objections, then an individual can rapidly become familiarized with the handling and firing of firearms and will thereby develop accuracy in shooting.

There are several examples in the patent literature of attempts that have been made to overcome the objections to live ammunition being used for target practice, either indoors or outdoors. However, in each of the examples of a prior art it is necessary to provide some form of projectile within the bore of the firearm. Since firearms, particularly those requiring high precision, are expensive it follows that they can be readily damaged by the projectiles that travel down the bore thereof in the prior art structures. Should the rifling in the bore be damaged by the target practice projectile subsequent firing with live ammunition may very well be erratic.

U.S. Pat. No. 882,551 is one example of the prior art referred to hereinabove. A scaled down target is placed in close proximity to the muzzle of the firearm and a spring loaded rod is placed within the bore of the barrel through the breech end or cartridge chamber. When the trigger is pulled the firing pin forces the rod out of the muzzle end of the barrel and causes a needle that is integral with the rod to strike and pierce the target which is approximately 6 to 8 inches away. It will be evident that, with the structure described in the foregoing patent, the rifle must be taken apart in order to utilize the attachment and the attachment must utilize the bore of the rifle. Both of these conditions are undesirable for the reasons given hereinabove.

Another example of the prior art to which the present invention is directed is shown in U.S. Pat. No. 1,016,150 which relates to practice apparatus for small arms such as a handgun. Once again a target is placed in close proximity with the muzzle of the handgun and a spring-loaded projectile is placed within the bore thereof. A brass tube or the like is inserted in the muzzle of the gun and a slideable rod is placed within the tubing. When the gun is fired the rod is ejected and marks a target. Once again, and in common with the foregoing prior art, the attachment is placed within the bore of the firearm with the consequential possibility of damage thereto.

Still another example of the prior art is disclosed in U.S. Pat. No. 1,125,475. As in the previous examples of the prior art, a target is placed in close proximity with the muzzle of the firearm. A coil spring is placed within a barrel of the firearm and, when the trigger is pulled, the coil spring is urged forwardly so that a needle which may be formed on the end of a spring itself (and which may also be formed on the end of a plug that is secured to the spring) may mark the target. The structure disclosed in this last mentioned U.S. Patent also requires that the attachment be placed within the bore of the firearm with the attendant, detrimental results mentioned hereinabove.

SUMMARY OF THE INVENTION

The present invention overcomes the defects prevalent in the prior art structure and provides a simple attachment for a firearm such as a handgun or the like wherein the attachment is releasably clipped to an external portion of the barrel of the firearm. The attachment is in the form of a tubular cylinder having an open forward end. An elongated rod is slideably contained within the cylinder with the forward end of the rod being adjacent the forward open end of the cylinder. The rearward end of the rod is secured to or integral with a pair of arms that extend outwardly of the cylinder to a position adjacent the hammer of the firearm. Thus, when the trigger is pulled, the hammer displaces the arms forwardly and the arms, in turn, drive the rod outwardly of the muzzle end of the firearm into engagement with a target which is placed in close proximity with the muzzle of the firearm. In one embodiment of the present invention the rod is spring loaded such that it automatically returns to its retracted or rearward position after each firing. Alternatively, latch means may be provided on the outside surface of the cylinder with a portion of the latch means extending inwardly of the cylinder to releasably retain the rod in its rearward position prior to each firing. It should be noted that, in both of the embodiments of the invention, the force imparted by the hammer drives the arms and the rod in a forward direction overcoming the force of either the spring or the force of the retaining latch.

Accordingly, it is an object of the present invention to provide an improved target practice attachment for a firearm.

Another object of the present invention is to provide an improved target practice attachment as described above, that may be applied to the external surface of the firearm and which is responsive to the actuation of the hammer thereof.

Still another object of the present invention is to provide an improved target practice attachment for a firearm, as described above, wherein the bore of the firearm is not utilized during target practice.

Still another object of the present invention is to provide an improved target practice attachment for a firearm, as described above, wherein spring means automatically return the projectile utilized during the target practice to a normal, rearward position after each firing.

A further object of the present invention is to provide an improved target practice attachment for a firearmm or the like, as described above, which utilizes releasable latch means for retaining the projectile prior to each firing thereof.

It is still another object of the present invention to provide an improved target practice attachment for a firearm of the like, as described above, which may be utilized with a reduced scale target that is placed in close proximity with the muzzle of the firearm.

These and other objects, features and advantages of the invention will, in part, be pointed out with particularity, and will, in part, become obvious from the following more detailed description of the invention, taken in conjunction with the accompanying drawing, which forms an integral part thereof.

BRIEF DESCRIPTION OF THE DRAWING

In the various figures of the drawing, like reference characters designate like parts.

In the Drawing

FIG. 1 is a side elevation of the present invention shown attached to a firearm, for example a handgun;

FIG. 2 is an end elevational view of the present invention taken along line 2—2 of FIG. 1;

FIG. 3 is an enlarged, longitudinal sectional elevational view illustrating one embodiment of the present invention; and FIG. 4 is an enlarged, fragmentary elevational view, partially in section illustrating an alternative embodiment of the present invention.

DESCRIPTION OF THE PREFERRED EMBODIMENT

One embodiment of the target practice attachment 10 comprising the present invention is shown in FIG. 1 in position on the barrel B of a firearm F which is illustrated as a handgun by way of example only. It should be clearly understood that the present invention may be utilized with a rifle, a carbine, a shotgun or the like. A target A is placed in close proximity with the muzzle M of the firearm F. The target A which is reduced in scale in a well-known manner is placed only a few inches away from the muzzle M. The firearm F also includes a trigger T which, after it is cocked and pulled, trips a hammer H in a conventional manner. The hammer includes a forwardly extending projection P whose function will be described hereinafter.

Turning now specifically to FIG. 2 it will be seen that the attachment 10 comprising the present invention includes an elongated cylinder 12 which may be either translucent or opaque. The right hand end 14 of the cylinder 12 is closed while the left hand end 16 of the cylinder 12 is initially open but, as is illustrated, contains a threaded plug 18 having a central bore 20 therethrough. The plug 18 may be made of a hardened steel to assume less wear after protracted use.

The cylinder 12 is further comprised of a transverse, internal wall 22 intermediate the ends 14 and 16 thereof. A longitudinally extending bore 24 is formed through the transverse wall 22. Although not absolutely essential a hardened sleeve 25 may be placed in the bore 24 to achieve greater accuracy. The bore of the sleeve 25 and the bore 24 are made as coaxially accurate as desired for a given degree of precision firing. As shown in FIG. 3 the transverse wall 22 defines, in part, fore and aft chambers 26 and 28, respectively.

The cylinder 12 is further comprised of an elongated, axially extending slot 30 through the wall thereof proximate the rearward end of the aft chamber 28. In addition, the cylinder 12 is also provided with two pairs of axially spaced apart straps 32 that are adapted to releasably engage the barrel B of the firearm F as shown in FIGS. 1 and 2. In one embodiment of the present invention magnets 34 are embedded in or applied to the inside surface of each of the straps 32, such as by suitable adhesives or the like, in order to assist in the retention of the cylinder 12 on the barrel B of the firearm F. Alternatively, the straps 32 may be made from a suitable resilient material such as spring steel for example.

An elongated rod 36 having a pointed forward end 38 and downward threaded end 40 is slideably contained within the cylinder 12. For maximum accuracy the diameter of the rod 36 need only be slightly smaller than the two axially spaced apart bores within which it is guided. Intermediate the ends 38 and 40 thereof, the rod 36 is provided with a shoulder 42. The rod 36 is first inserted through the open end 16 of the cylinder 12 and through the bore 24 (or the sleeve 25) formed in the transverse wall 22 before the rearward end 40 thereof is threaded into a plug which is generally designated by the reference character 44. A compression spring 46 is then inserted in the forward chamber 26 and positioned about the forward end 38 of the rod 36 so as to bear against the shoulder 42 thereof. The foward end 16 of the cylinder 12 may then be closed by the threaded plug 18 with the forward end 38 of the rod 36 extending through the bore 20 formed in the plug 18.

As shown in FIG. 3 a resilient cushion 48 is inserted in the aft chamber 28 to the right of the plug 44. The cushion 48 may be inserted through the slot 30. The plug 44 further comprises, as shown in FIG. 3, a pair of arms 50 that extend through the slot 30 in a rearward direction and into engagement with the projections P of the hammer H. Thus, after cocking, the trigger T may be pulled so that the hammer H drops thus forcing the projections P in a forward direction thereby striking the arms 50. This action propels the plug 44 and the rod 36 in a forward direction (to the left in FIG. 1) so that the forward end 38 of the rod 36 may puncture the target A such as shown in FIG. 1. It should be noted that the target A is reduced in scale and is placed only several inches away from the muzzle M of the firearm F. Although it is not absolutely essential to the basic concept of the present invention it will be realized that the forward movement of the rod 36 will compress the spring 46 so that, after firing, the spring 46 will automatically return the rod 36 to its initial position shown in FIG. 3.

An alternative embodiment of the present invention is shown in FIG. 4. The alternative embodiment differs from the first described embodiment in that, instead of utilizing a spring 46 for returning the rod 36, a latch mechanism, generally designated by the reference character 52 is utilized for releasably holding the rod 36 prior to each firing. The cylinder 12' is provided with a cutout 54 through which passes a spring finger 56 such that the inner end thereof is in light engagement with a shoulder 58 formed on the rod 36'. The shoulder 58 has a beveled rearward end 60 which abuts against the shoulder 62 formed on the inside surface of the cylinder 12'. The beveled rearward end 60 permits the shoulder 58 to move to the right and bypass the spring finger 56. A pivot pin 64 supports the latch member 52 on a fulcrum 66 that is formed integrally with the outside surface of the cylinder 12'. In addition, a spring 68 normally biases the latch member to the position shown in FIG. 4. Thus, the latch mechanism 52 will normally hold the rod 36' in the rearward position before each firing. However, after the trigger T is pulled the force exerted by the hammer H will easily force the shoulder 58 to the left past the spring finger 56 so that the rod 36' may puncture the target A. The rod 36' is then returned manually to the position shown in FIG. 4.

From the foregoing it will be appreciated that an improved, target practice attachment for a firearm has been provided. The firearm may be used in a conventional manner for target practice utilizing the front and rear sights $S_1$ and $S_2$, respectively, without placing the attachment internally of the firearm. Thus, the rifling within the bore of the firearm cannot be mutilated. By compensating in a conventional manner for the displacement of the axis of the rod from the axis of the bore of the firearm the results of the target practice can easily be observed.

There has been disclosed heretofore the best embodiments of the invention presently contemplated. However, it is to be understood that various changes and modifications may be made thereto without departing from the spirit of the invention.

What is claimed is:

1. A target practice device for temporary attachment to a firearm, said firearm having a handle grip at one end, an elongated barrel extending along a longitudinal axis from the handle and terminating in a muzzle, a trigger and a displaceable hammer responsive to the pulling of the trigger for normally firing the firearm, said device comprising:

a. an elongated, tubular cylinder extending along a longitudinal axis and having an open, forward end;

b. mounting means for removably securing said cylinder on the outside surface of the elongated barrel of the firearm with the longitudinal axis of said cylinder being substantially parallel to the longitudinal axis of the firearm and with the open end of said cylinder being adjacent the muzzle of the firearm;

c. a captive elongated rod slidably mounted permanently contained within said cylinder, said rod having a forward end contained within said cylinder in a cocked position which extends from the said open end in a discharge position; and d. means movable in response to the pulling of the trigger and the consequent displacement of the hammer for axially displacing said rod along the interior of said cylinder whereby the forward end of said rod emerges from the open end of said cylinder and is thereby adapted to strike a practice target said means including a portion of said rod extending exteriorly of the cylinder to a position so located as to be struck by the hammer of the firearm.

2. The device according to claim 1 wherein said mounting means comprises clip means for securing said attachment to the barrel of the firearm.

3. The device according to claim 1 wherein said mounting means comprises clip means integral with said cylinder.

4. The device according to claim 3 wherein there are two of said clip means axially spaced apart from each other and each of said slip means comprises a pair of legs that are arranged to grip the barrel of the firearm.

5. The device according to claim 4 wherein magnet means are secured on the inside surface of said legs.

6. The device according to claim 1 wherein there are further included means for returning said rod to the retracted position after each firing.

7. The device according to claim 6 wherein said means for returning said rod comprises a compression spring arranged to urge said rod rearwardly relative to the open end of said cylinder.

8. The device according to claim 1 further including means for releasably retaining said rod in a retracted position prior to each firing.

9. The device according to claim 8 wherein said retaining means is a resiliently biased latch.

10. The device according to claim 9 wherein said latch includes a resilient spring finger for engaging a portion of said rod prior to each firing.

* * * * *

UNITED STATES PATENT AND TRADEMARK OFFICE

CERTIFICATE OF CORRECTION

PATENT NO. : 4,046,130

DATED : September 6, 1977

INVENTOR(S) : GEORGE NAJARIAN

It is certified that error appears in the above-identified patent and that said Letters Patent are hereby corrected as shown below:

In the Claims, Claim 4, Column 6, line 16, change "slip" to --clip--.

Signed and Sealed this

*Sixth* Day of *December 1977*

[SEAL]

*Attest:*

RUTH C. MASON
*Attesting Officer*

LUTRELLE F. PARKER
*Acting Commissioner of Patents and Trademarks*